US007226038B1

(12) United States Patent
Wickstrom

(10) Patent No.: US 7,226,038 B1
(45) Date of Patent: Jun. 5, 2007

(54) LOAD ARRESTOR, LIFTING SYSTEM AND METHOD

(76) Inventor: Jon Wickstrom, 101 Martin Rd., Waterloo, IA (US) 50701

( * ) Notice: Subject to any disclaimer, the term of this patent is extended or adjusted under 35 U.S.C. 154(b) by 144 days.

(21) Appl. No.: 11/090,332

(22) Filed: Mar. 25, 2005

(51) Int. Cl.
*B66D 1/48* (2006.01)

(52) U.S. Cl. ..... 254/276; 254/329; 254/375

(58) Field of Classification Search ..... 254/267, 254/276, 329, 332, 375; 242/247, 297
See application file for complete search history.

(56) References Cited

U.S. PATENT DOCUMENTS 4,520,998 A * 6/1985 Flaig ..... 254/267
4,834,341 A * 5/1989 Baum ..... 254/375
4,846,313 A * 7/1989 Sharp ..... 188/187
5,127,631 A 7/1992 Flaig
5,458,318 A * 10/1995 Jussila ..... 254/267
5,934,408 A 8/1999 Flux
6,123,280 A * 9/2000 Yuen et al. ..... 242/247
6,332,439 B2 * 12/2001 Sekiya et al. ..... 123/90.17
6,386,164 B1 * 5/2002 Mikame et al. ..... 123/90.17
6,431,482 B1 * 8/2002 Ikuta ..... 242/297
6,483,047 B1 11/2002 Zaharia et al.
6,530,454 B1 3/2003 Renton et al.
6,550,746 B2 * 4/2003 Drost ..... 254/332
6,684,634 B1 * 2/2004 Sakamoto ..... 60/444

OTHER PUBLICATIONS

A.R.M.S. Inc; 3-D ARM; one-page drawing of anti-drift brake having off-set locking cylinders; Jul. 11, 2001; A.R.M.S. Inc, Cedar Falls, IA; device presented in United States.

* cited by examiner

*Primary Examiner*—Emmanuel M Marcelo
(74) *Attorney, Agent, or Firm*—Anthony J. Bourget

(57) ABSTRACT

A load arrestor for use in conjunction with a primary lift, the load arrestor comprising a spool about which winds a safety line attached to a load supported at least in part by the primary lift, a lock mechanism comprising a lock plate connected to and rotatable with the spool, the plate defining a plurality of slots; and at least one cylinder having a locking pin for insertion into at least one of the plurality of slots to inhibit rotation of the lock plate and the spool; a sensor for sensing motion of the spool; and a controller which sends a signal to the at least one cylinder to activate the locking pin when the motion of the hoist drum exceeds a predetermined limit. Alternate aspects of the load arrestor are also provided.

23 Claims, 9 Drawing Sheets

LOAD ARRESTOR, LIFTING SYSTEM AND METHOD

BACKGROUND

This invention relates to a safety mechanism for use in conjunction with a primary lift having a lowering motion limit. The safety mechanism includes a brake mechanism which is activated when the lowering motion (i.e., speed or acceleration) of the load exceeds a predetermined limit.

DESCRIPTION OF THE RELATED ART

Safety mechanisms of this general variety are not uncommon. Some lifts or hoists include built-in safety mechanisms such as those disclosed in patents to Flaig, U.S. Pat. No. 4,520,998, which issued Jun. 4, 1985, and U.S. Pat. No. 5,458,318 issued to Jussila on Oct. 17, 1995. Other general types of arresting devices are used by maintenance personnel, for instance, who climb tall structures, such as in the patent to Flux, U.S. Pat. No. 5,934,408, issued Aug. 10, 1999, and other various arrangements exist which operate on similar general principles of centrifugal ratcheting brakes or the like. While such mechanisms have been in use for some time, they have not been considered workable for inhibiting loads from dropping within an acceptable predetermined distance. Some such devices take between approximately two to three feet to stop a falling load. Moreover, some such mechanisms are not used in conjunction with a primary lift in the form of a secondary safety line, and do not arrest a load in the case of total lift failure or total line failure. Others that may be used with a primary lift simply do not arrest a load in a short distance.

Of special concern in the manufacturing industries, particular the automobile and truck manufacturing industries, or other assembly line applications, involves use of safety systems to prevent or guard against falling loads (and also to comply with occupational safety guidelines). Typically a load will be supported on a hoist and transported about an assembly line for manufacture as is common. Workers are often required to place themselves, or their hands or other body parts underneath or adjacent the suspended and moving loads. If a hoist should fail, or if a line breaks, the worker could suffer physical injuries. Moreover, it is desired to limit the number of safety lines, hoses, or other items that might obstruct the free flow of the assembly line or otherwise create delays or make the production process more complicated. Thus, use of complicated and/or expensive mechanisms to guard against a load lifting failure is to be minimized. Moreover, ideally loads could be stopped within a very short distance of a failure condition, since a drop of even a few feet, or sometimes even a few or several inches could result in injury. Further, having load arresting equipment capable of consistently stopping a load within a short distance could provide additional flexibility in the assembly tasks and in cases where there were previous uncertainties or elevated risks. Further, it is important to maintain an arrestor product such that the safety line is constantly in tension so as to avoid sagging of the line which would result in less responsive arresting action. Other applications and industries, including but not limited to the elevator industries, also have safety needs for arresting a falling mass.

Accordingly, there is a desire to present a load arrestor that overcomes limitations of the prior art, and which stops a load from falling within a fraction of a second of a hoist chain or cable failure, and to do so within a short travel distance. There is a further desire to present a load arrestor that provides a tensioned safety line that works in conjunction with a line from a primary lift. A further desire is to provide an inexpensive and less complex arrestor that can be used on or in conjunction with any number of lifts or lifting systems. These and other desires or objects of the present invention will become apparent from the following detailed description considered in conjunction with the accompanying drawings and claims.

SUMMARY

The present invention pertains to a load arrestor for use in conjunction with a lift. In a typical setting the lift includes a lift line that at least in part supports the load. When either the lift or lift line fail, the load arrestor senses unacceptable acceleration of the load and operates to arrest the load within an acceptable time or distance. Preferably the load arrestor has a tension mechanism which allows a safety line connected between the load and load arrestor to remain taught so that an immediate locking action is achieved upon a failure condition. Preferably the invention includes fail safe mechanisms in the event of electrical failure or loss of air or hydraulic pressure. The invention further includes a safety lifting system having at least one lift and at least one load arrestor. The invention also includes a method for arresting a load which descends at an unacceptable rate. Further aspects of the invention are presented in greater detail in the following detailed description, drawings and claims.

DETAILED DESCRIPTION

Figure 1:
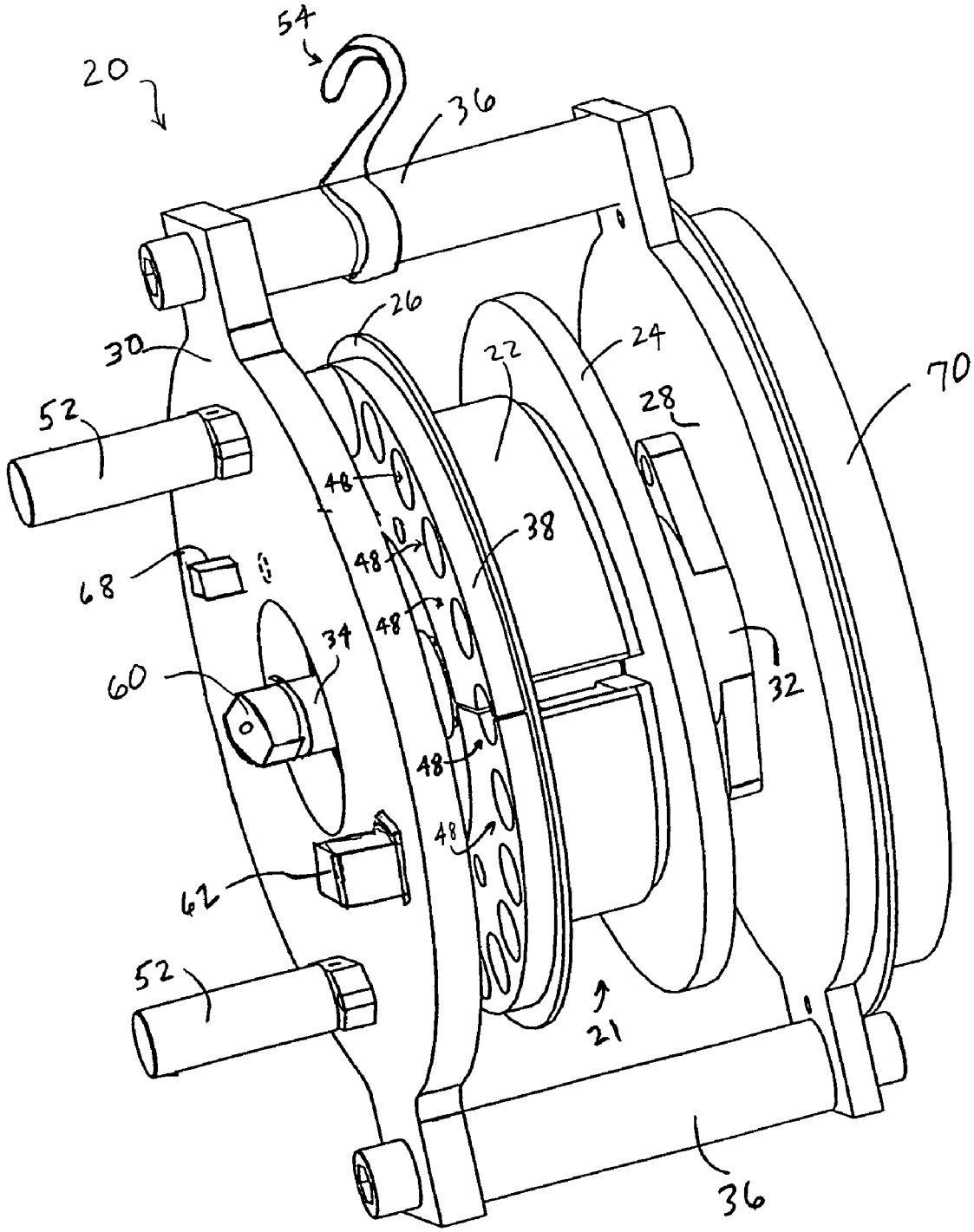
FIG. 1 is a perspective view of a load arrestor according to one aspect of the invention.
Figure 2:
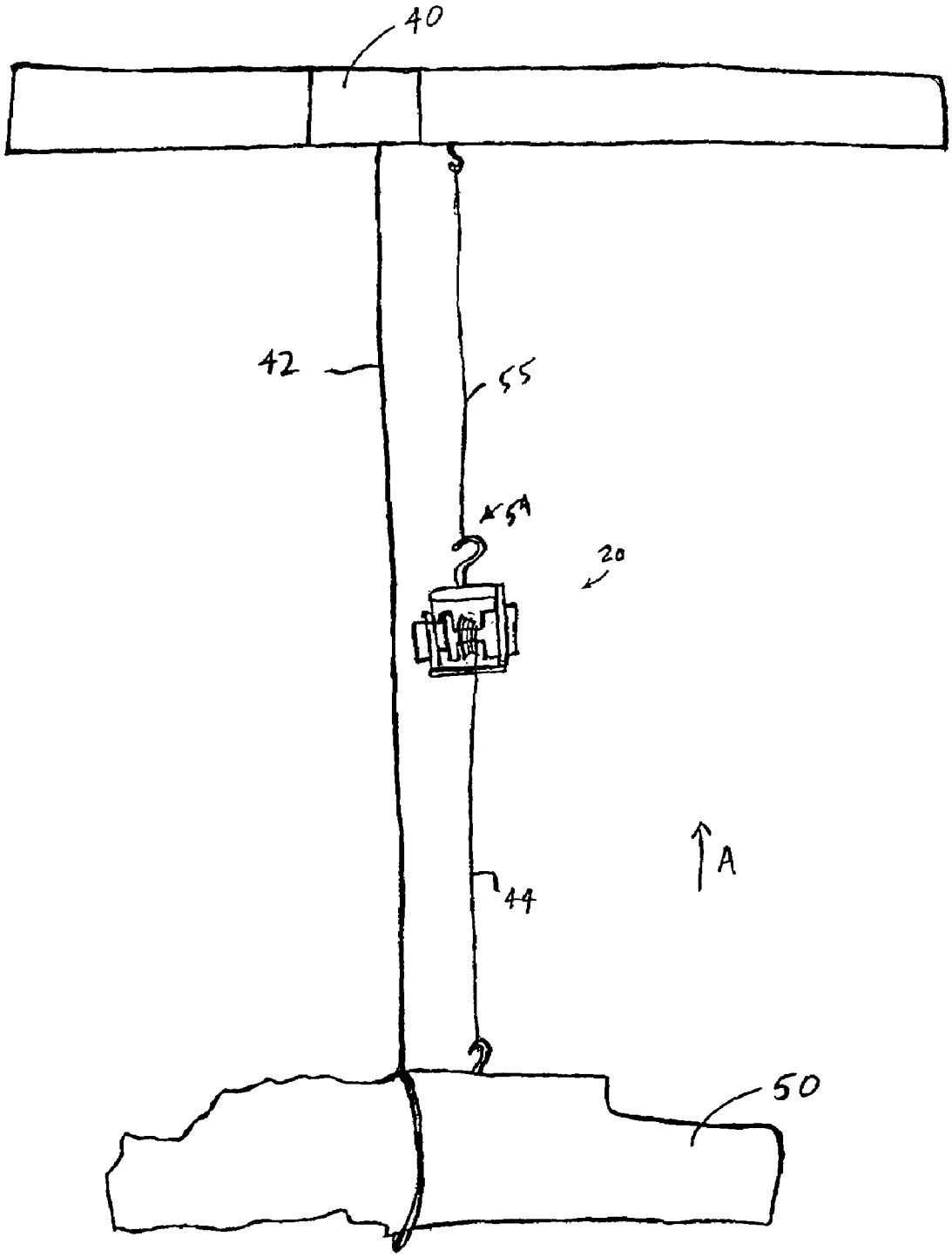
FIG. 2 is an elevation view of a load arrestor in operation according to the invention.

Referring now to FIGS. 1 and 2, a load arrestor which incorporates one aspect of the present invention is illustrated and generally designated by the reference numeral 20. Arrestor 20 is capable for use in conjunction with a lift 40. Lift 40 may be one of a variety of lifting devices, including a crane, a hoist, a barrel drum, pulley system, or any other type of device used to lift a load. Lift 40, having a lift line 42, at least in part supports load 50. In the event of a failure condition such as failure of lift 40 or of lift line 42, load arrestor 20 inhibits descent of load 50 within an accepted time or distance.

Arrestor 20 includes spool 22 which is preferably cylindrical and around which a safety line 44 is wound. Safety line 44 is attached to load 50 in a desired fashion. While lift line 42 and safety line 44 are preferably a steel wound cable, they may include any number of suitable lines of varying type or dimension, including for example, a chain, rope, cable, belt, or other load supporting line depending upon the desired lifting operation. Generally safety line 44 provides safety support of load 50, yet may not actively support load 50 until or unless a failure condition occurs.

Spool 22 is situated between right side plate 24 and left side plate 26, the combined spool mechanism forming a channel 21 for receiving a line to be wound. Spool 22, together with side plates 24, 26, are rotatably engaged between right end plate 28 and left end plate 30 with flange bearing 32 or other rotatable mechanism. As can be appreciated, preferably a flange bearing 32 is situated on either side of spool 22 to accommodate rotation of spool 22. Preferably spool 22, side plates 24, 26, and end plates 28, 30, are made of metal. Tie rods 36 provide alignment and spacing for the spool mechanism.

As shown in FIG. 1, arrestor 20 further includes lock disc 38 which is connected to and rotatable with spool 22. Disc 38 is preferably connected to spool 22 at left side plate 26. Disc 38 includes a plurality of slots 48 located toward the outer perimeter of disc 38. Preferably, disc 38 is circular and preferably slots 48 are circular apertures spaced apart substantially equally. Slots 48 are configured to receive locking pins 46 (see FIG. 3). Preferably slots 48 are positioned substantially parallel in the axial direction of spool 22 as shown. A locking pin 46 is contained within each of cylinders 52, or more preferably locking pins 46 are treaded to the ends of each cylinder rod (rods not shown).

Figure 3:
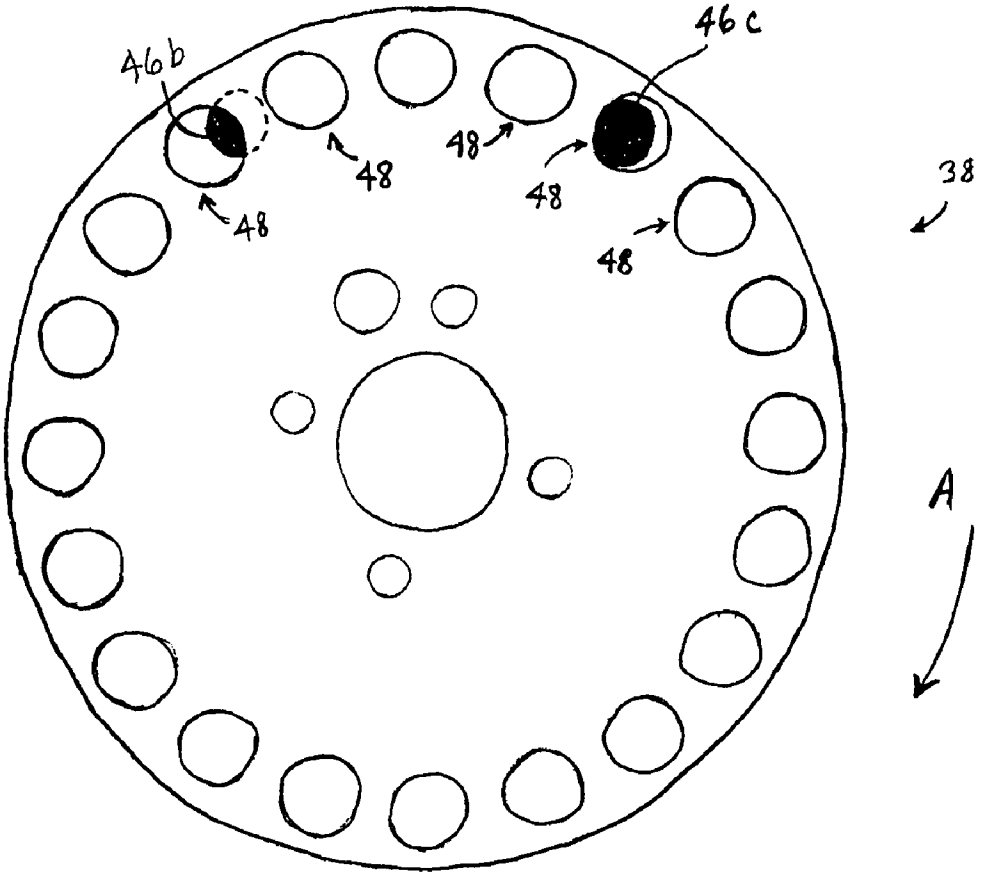
FIG. 3 is a top view of a lock disk of the present invention.
Figure 4:
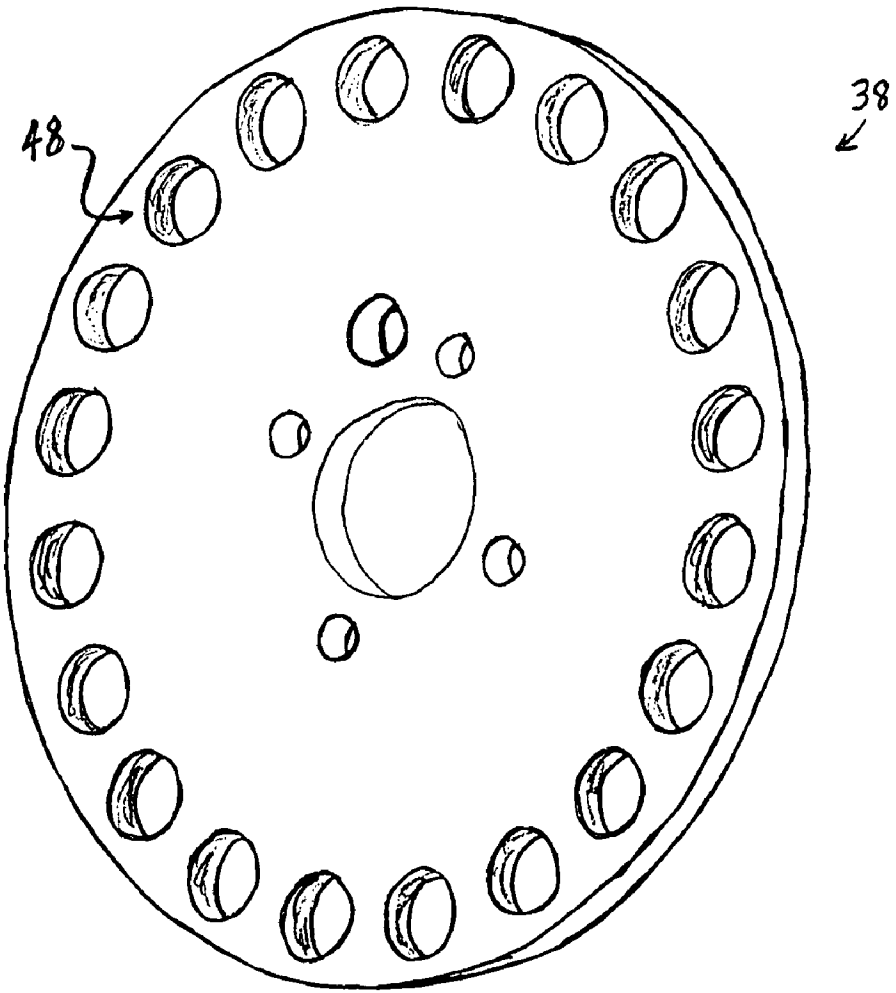
FIG. 4 is a perspective view of the lock disc shown in FIG. 3.

Arrestor 20 can be dimensioned to support safety line 44 having varying lengths, depending upon the circumference of spool 22 and clearance dimension relative to tie rods 36. Preferably, spool 22 has a diameter of approximately five inches. It may be appreciated that spool 22 may have a small diameter so that a relatively greater length of safety line 44 may be wound around it. While FIG. 1 shows a notched piece spool 22, it may be appreciated that spool 22 may be of singular design as shown in FIG. 3 and FIG. 4. Preferably lock disc 38 has a diameter of approximately eleven inches. Preferably lock disc 38 includes a sufficient number of slots to increase the response speed of a locking action, and preferably has about 20 apertures. Preferably Slots 48 are apertures having a diameter of about one inch and locking pins 46 preferably have a diameter of about ½ inch. While FIG. 1 shows a split piece lock disc 38, it may be appreciated that a singular piece may be configured as shown in FIG. 3 of FIG. 4.

Figure 5:
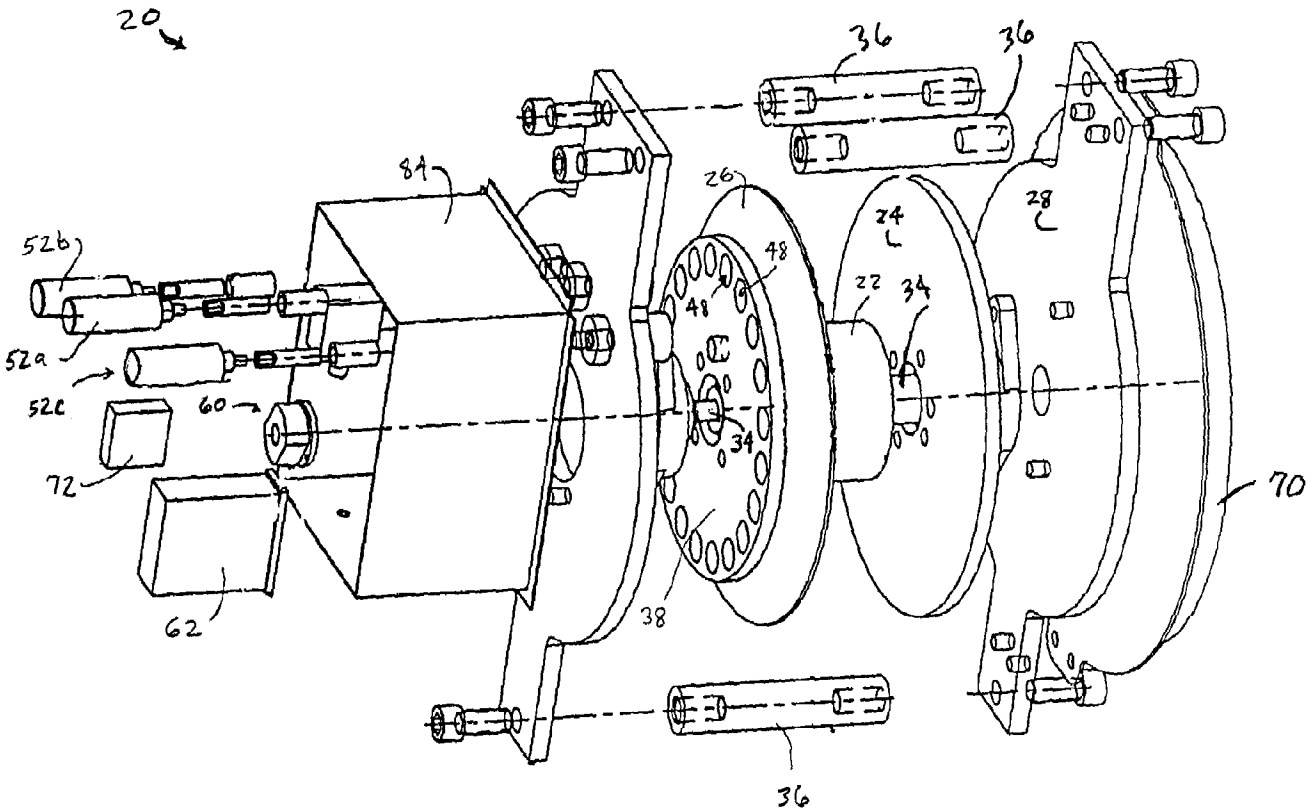
FIG. 5 is an exploded view of a load arrestor according to a further aspect of the invention.
Figure 6:
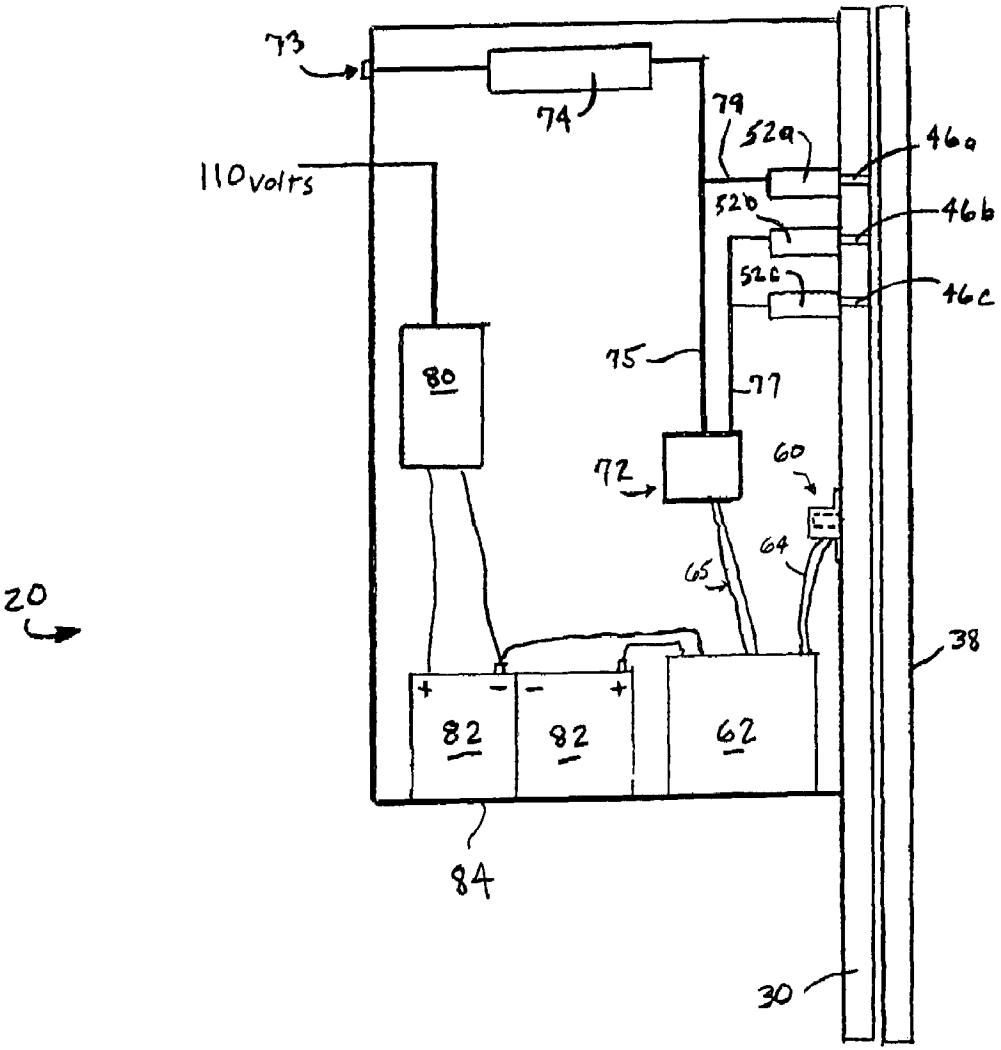
FIG. 6 is a diagram arrangement of certain components of a load arrestor according to the present invention.

A preferred aspect of the invention is shown with reference to FIG. 5 and FIG. 6. Arrestor 20 includes a sensor 60 which senses motion of spool 22 in response to motion of load 50. Sensor 60 is engaged with spool shaft 34. Preferably sensor 60 is an encoder device. One such encoder is manufactured by Encoder Products Co., such as the Model 725 Size 25 Round Series optical shaft encoder which converts input shaft rotation into square wave output pulses. Preferably, resolutions from 1 to 30,000 cycles per revolution are available with such encoder 60 to produce high sensitivity of changes in rotational speed or acceleration.

Alternatively, and while not preferred, sensor 60 may comprise a notched disc with a photo eye to measure the speed of rotation of spool 22. Applicant has found, however, that an encoder of the type and variety described above, for example, has greater sensitivity for determining a rate of motion and thereby can more quickly sense a failure condition.

An output signal from sensor 60 is transmitted to controller 62, preferably via a signal line 64. Controller 62 monitors the speed of spool 22 via sensor 60. One such controller is manufactured by TURCK Inc., such as the model MK21-12ExO-R rotational speed monitor. Such controller 62 is programmable to send output signals upon detection of a failure condition.

An output electrical signal from controller 62 is preferably transmitted to solenoid 72, preferably via a signal line 65. Preferably solenoid 72 is a three-way, normally closed, 24 volt solenoid. Solenoid 72 also preferably receives air via input line 75 from a pressurized air source, preferably a canister 74 which holds pressurized air. An output line 77 transports air from solenoid 72 to cylinders 52*b* and 52*c*. Each cylinder 52 includes a locking pin 46 for extension into lock disc 38. It may be appreciated that fewer or additional cylinders 52 may be employed. When a signal from controller 62 is received by solenoid 72 representing a failure condition (caused by sensor 60 sensing an unacceptable motion of load 50), solenoid 72 opens to allow pressurized air to flow from canister 74 through air output line 77 to activate cylinders 52 thereby extending locking pins 46 into lock disc 38.

Controller 62 is typically an integrated device or computer, and contains data in memory regarding the revolutions per minute (rpm) of spool 22 and relative locations of load 50. The operational parameters of controller 62 prevent spool 22 from running faster than allowed for the lowering motion of load 50. This control feature prevents run-away of load 50 when there has been a failure of lift 40 and/or of lift line 42, or otherwise where a preset speed of descent is exceeded. An operator may select, for instance, the limit of revolutions per minute of spool 22 (which is proportional to the ascent or descent speed of load 50) at the controller 62. Controller 62 sends a signal to solenoid valve 72 when the rpm of spool 22 exceeds the preset setting. The cylinder 52 thereby supplies air to extend the locking pin or pins 46 into slots 48 in the lock disc 38. Extending the pins 46 into slots 48 locks spool 22. Depending upon the particular configurations, the load 50 will preferably drop no more than approximately six inches from the point of detection of a failure condition. Thus, workers who are beneath the load or who have hands or other body parts beneath the load may avoid injury. While employing an arrestor 20 as described above, applicant has observed successful repeated arresting, within approximately 6 to 7 inches, of a dropped 2000 pound load. It may be appreciated that variations of the load amount, speeds and distances of travel may be realized depending on the particular features and settings of the components used herein.

While the air activated variety of cylinders 52 is preferred, it may be appreciated that cylinders 52 may be of varied dimension and type, it being understood that such cylinders might also be fluid or magnetically activated, and are not confined to being cylindrical in shape. Where cylinder 52 is of an electromagnet variety, air need not be stored in a canister. It may also be appreciated that hydraulics, while not entirely practical, may also be used with or as cylinders 52.

Preferably at least one of the cylinders 52 is of a normally open variety 52*a*. As such, the locking pin 46 associated with cylinder 52*a* is configured to be constantly urged into slots 48, typically by use of a spring (spring not shown). Pressurized air is supplied from canister 74 to cylinder 52*a* via fail-safe line 79 in order to maintain locking pin 46 in a retracted position. As such, cylinder 52 provides a fail safe mechanism in the event of a drop in air pressure within canister 74 or the related lines. When air pressure drops below the spring biasing amount, locking pin 46 will extend and enter into one of the plurality of slots 48 to thereby arrest load 50. Once pressure is restored to canister 74 (via refill line 73, or by fixing or replacing any of the pressure lines or seals as needed), locking pin 46 associated with cylinder 52*a* retracts from slot 48 to thereby allow spool 22 to rotate.

Preferably arrestor 20 further includes an electrical fail safe mechanism so that locking pin 46 is poised to be fired even in the case of an electrical power loss to primary lift 40 or arrestor 20. Load arrestor 20 may generally be designed to receive power from the primary lift or other source to operate controller 62. Applicant has found, however, that it is preferable to provide a charger and battery source of electricity to operate the controller 62 to remove dependence on external sources. As shown in FIG. 6, a charger 80 is preferably charged via 110 volt electrical supply. Charger 80 in turn provides 24 volt direct current to a battery such as batteries 82. Preferably batteries 82 are each 12 volt rechargeable batteries, aligned in series to provide 24 volts to power controller 62. Thus, arrestor 20 is operable even in a case where the main power supply to the hoist 40, arrestor 20, or working environment is lost or interrupted.

Solenoid 72 is normally closed and receives a signal from controller 62 in order to activate locking when acceleration occurs. Solenoid 72 fires the cylinders when a signal from the controller is received. While not preferred, solenoid may be normally open and configured to continuously receive a signal from controller 62 in order to remain closed. This however creates heat and may result in chatter loss of air pressure.

If a failure condition occurs and load arrestor 20 is activated, a reset step is preferably required in order to reactivate the arrestor 20 to allow for rotation of spool 22. Preferably arrestor 20 includes box 84 for containing those components as best shown in FIG. 6. To reset the arrestor 20 a user would open box 84. Arrestor 20 may include a button (not shown) inside box 84 to operate the reset step where the cylinders retract when the button is pushed (assuming no load 50 is present). Preferably, however, the three-way solenoid valve includes an exhaust port to remove the otherwise trapped air so the pins can be retracted. A maintenance worker may reset the arrestor upon confirming the load has been removed or the primary lift has been repaired and is holding the load.

While not preferred, an optional pressure sensor (not shown) may be operatively connected with cylinders 52 of an air cylinder variety to detect a pressure setting within the cylinders 52. In such case, a pressure sensor may preferably be configured with two setting levels, a first level for turning on a warning light if pressure drops below a first preset setting, and a second level for activating the locking pin 46 if pressure drops below a second preset setting.

Preferably arrestor 20 includes at least two cylinders 52, each having locking pins 46 for insertion into at least one of the plurality of slots 48. Preferably, as generally shown in FIG. 3, at least two of the pins 46*b* and 46*c* associated with cylinders 52 are offset (i.e., positioned such that at least two of the pins 46 avoid identical alignment with respect to the respective slots 48) such that when the cylinders 52 are activated, at least one pin 46 enters a slot 48 (or at least one pin 46 is at least positioned for a faster entry into a slot 48). As shown in FIG. 3, locking pin 46*c* was first to enter one of the slots 48, while pin 46*b*, being activated by associated cylinder 52*b*, did not enter one of the slots 48 but instead abutted lock disc 38. It may be the case that each of pins 46*c* and 46*b* fail to immediately enter a slot 48, however the continued and swift rotation of disc 38 results in swift alignment of at least one pin 46 with a respective slot 48 for quick insertion. With such an offset configuration the rotational distance traveled by lock disc 38 prior to receiving a pin 46 within a slot 48 may be reduced or eliminated since locking pins 46 are positioned at various phase angles to hasten the response time when at least one of pins 46 enters into at least one of slots 48. Preferably, the dimensions of the pins 46 and of the slots 48, together with the spacing of the cylinders 52, may be established such that at least one of the locking pins 46 fires into an open slot 48 without having to wait (or to minimize the wait) for further rotation of lock disc 38.

FIG. 3 shows lock disc 38 having a plurality of slots 48 and a plurality of pins 46, and illustrates the simultaneous firing of pins 46*b–c*. Locking pin 46*c* has been fired into position where it has entered slot 48. Since cylinders 52 associated with respective locking pins 46*b* and 46*c* are offset, pin 46*b* did not enter the respective slot 48. As such, locking pin 46*c*, upon entry into its corresponding slot 48, effectively locks lock disc 38 and prevents lock disc 38 from further rotation in the direction of arrow A. Since lock disc 38 does not rotate further, pin 46*b* does not enter into slot 48. It can be appreciated that using additional cylinders 52 at various off-set positions may effectively increase the speed at which lock disc 38 is locked since a greater number of off-set locking pins 46 covers a greater number of phase angles of lock disc 38. Increasing the number of off-set cylinders 52 increases the possibility of having a locking pin 46 positioned immediate a slot 48 for immediate entry and increased locking speed.

Preferably slots 48 are apertures positioned into and/or through lock disc 38. It can be appreciated that alternative slot configurations can be utilized as desired, including a ratchet or saw-tooth type of configuration positioned about the perimeter of lock disc 38; however, applicant has found use of apertures are preferred since they are relatively easy to manufacture and easily receive locking pins 46. Apertures 48 also allow disc 38 to maintain a substantially smooth surface about the perimeter of lock disc 38.

In one aspect of the invention, cylinder 52 may be an air cylinder configured with a spring that is biased-out and air pressure-retracted (i.e., a pressurized air canister is in communication with the cylinder to keep the pin 46 from firing). If and when air pressure drops within the canister, the spring inside the cylinder pushes out the locking pin 46 into slot 48 to stops spool 22 from rotation. This is an optional fail/safety feature to assure the cylinders are properly pressurized to activate when needed.

Arrestor 20 further and preferably includes a tension mechanism for tensioning or otherwise taking up slack in safety line 44. As load 50 is lowered with lift 40, safety line 44 is unwound from arrestor 20. Provided the descent of load 50 does not exceed a preset limit, arrestor 20 will not activate to arrest load 50. As lift 40 lifts load 50 upward in the direction shown as arrow A in FIG. 2, tension mechanism 70 operates to wind safety line 44 around spool 22 to take up slack in safety line 44. Arrestor 20 is therefore positioned to respond quickly to a failure condition. Lack of a tension mechanism would present an unacceptable sag in safety line 44 which would otherwise cause load 50 to descend an unacceptable amount upon a failure condition.

Tension mechanism 70 is preferably a wound coil or spring variety (not shown) operatively engaged with spool 22. As spool 22 rotates to release safety line 44 in a descending operation, tension mechanism 70 coils or winds to build resistance and thereafter operates to rewind safety line 44 about spool 22 when load 50 ascends in the direction of arrow A. Preferably tension mechanism maintains a continuous tension to safety line 44 and rewinding of spool 22. In general, tension mechanism 70 allows safety line 44 to provide some, albeit minimal, active support of load 50 when a failure condition is not present.

It may be appreciated that alternative tension mechanisms may be included to achieve similar results and may include for example a motor, a synchronizing air motor, a synchronizing electric motor with a sensor, or other equivalent mechanism for reducing sag. For applications where a long safety line 44 is required, such as in cases where there is a 60-foot lifting span, tension spring 70 might not be large enough to wind or coil to accommodate a tensioning operation. An alternative air motor and/or electrical motor with sensing or synchronizing device may be employed to reduce sag in safety line 44.

Arrestor 20 may further include a suspension 54 for suspending arrestor 20 from an overhead position including from a lift 40 or a boom or a portion of a lift. Suspension 54 may include a suspension line 55 and/or a hook for engagement with arrestor 20, preferably at a tie rod 36 location. It may be appreciated that arrestor 20 can alternatively be directly connected to an overhead boom or lift without use of a suspension line 55 (and/or without a hook), or otherwise fastened at an overhead position at tie rod 36 and/or end plates 28 and 30. Preferably suspension 54 would not include a suspension line 55 which itself may result in a failure.

FIG. 5 shows an exploded view of an aspect of the present invention having a plurality of cylinders 52. Cylinders 52 are arranged in an offset position relative to the substantially equally spaced slots 48 of disc 38. FIG. 3 illustrates one example of the footprint of fired pins 46*a–c*. Multiple cylinders 52 may be included to increase the response time for locking lock disk 38 in a failure condition. Multiple tie rods 36 can be included to accommodate desired structural characteristics of arrestor 20.

Figure 7:
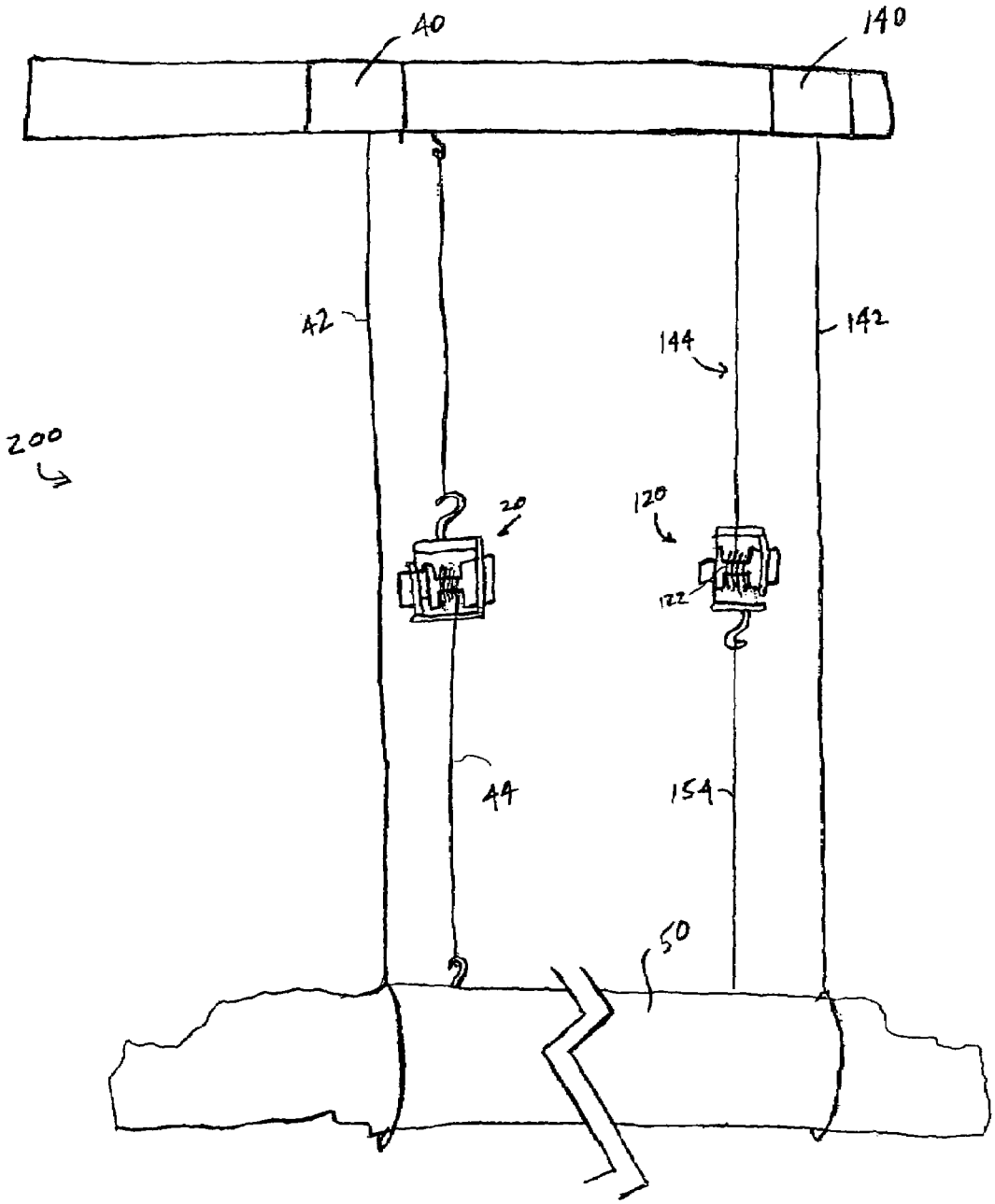
FIG. 7 is an elevation view of a system aspect of the present invention.

A further aspect of the invention includes an upside-down arrangement of the arrestor 120 as shown on FIG. 7. In the upside-down arrangement, arrestor 120 includes a safety line 144 for safety support of load 50. Safety line 144 is attached overhead. Arrestor 120 is configured for use in conjunction with a primary lift 140 which in part supports load 50. Arrestor 120 includes spool 122 about which winds the suspension 154. Arrestor 120 may include a suspension line 154 for connecting the arrestor 120 to load 50; however, to minimize risk of failure of line 154, arrestor 120 is preferably connected to load 50 in the present aspect. Arrestor 120 includes a lock mechanism including those features of the lock mechanism of arrestor 20 as described above and incorporated herein.

FIG. 7 shows a further aspect of the invention, including a safety lifting system 200. Lifting system 200 includes at least one primary lift 40 which is at least in part capable of supporting load 50. It may be appreciated that additional lifts 40 may be included if desired. System 200 also includes at least one arrestor 20 for use in conjunction with primary lift 40, the arrestor 20 having features as described above and incorporated herein be reference. System 200 may also include arrestor 120 or a combination of one or more arrestors 20 and 120. A single, or more than one arrestor 20, 120 may be used in conjunction with system 200. Preferably, at least two arrestors 20, 120 are positioned adjacent lift 40 so as to avoid a swinging action of load 50 in event of a failure condition.

Figure 8:
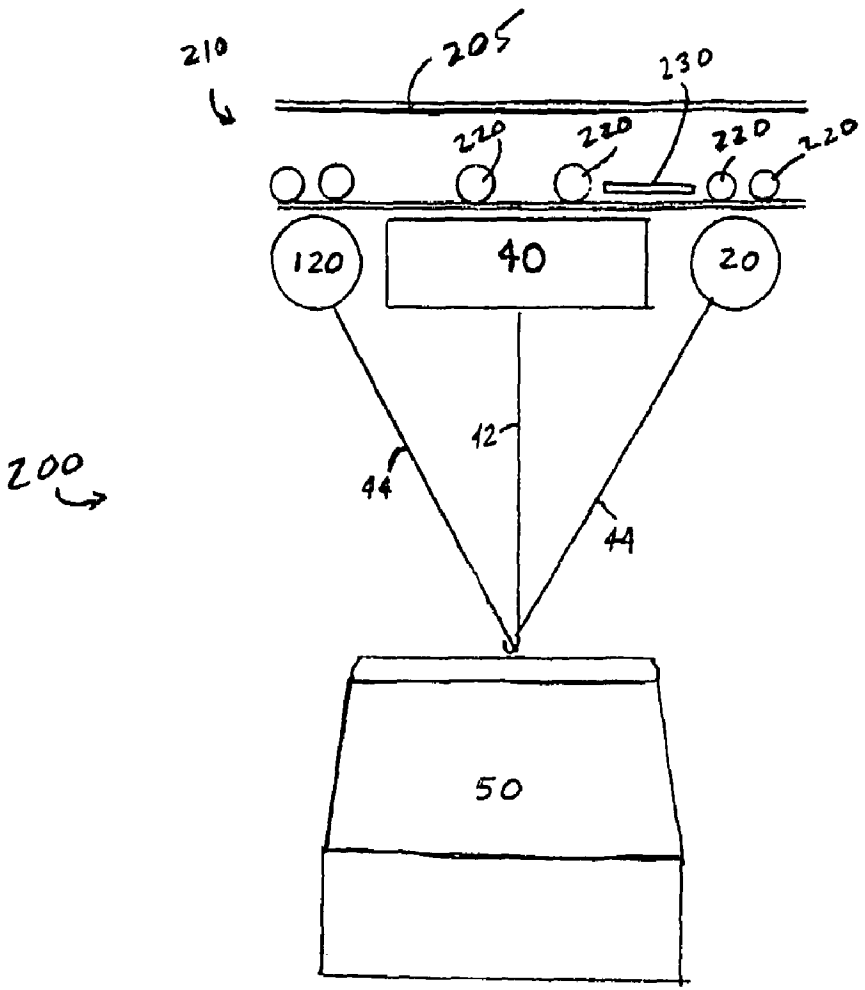
FIG. 8 is an elevation view of a further system aspect of the present invention.

Load arrestor 20, 120 may be useful in a track or rail-type system 210 which generally includes a hoist 40 suspended from trolley wheels 220 as is commonly positioned on a track or rail 205. See FIG. 8, for instance. Load arrestor 20 is also suspended from rail 205, having similar trolley wheels 220. Tow bar 230 connects trolley wheels 220 of load arrestor 20 to the trolley wheels of hoist 40 so that the load arrestor 20 follows along with the motion of hoist 40 as may be appreciated. A comparable tow bar arrangement is provided with respect to load arrestor 120 to accommodate use on a single hook system as shown in FIG. 8.

While arrestor 120 may preferably be similar to or identical with arrestor 20, it may be appreciated that only one or the other needs to include a sensor 60 together with a controller 62 as described above. Thus, if arrestor 20 includes both a sensor 60 and controller 62, arrestor 120 may lack such components, instead being equipped with a signal line (not shown) running from the controller 62 to the solenoid 72 of arrestor 120. In such case, the controller 62 activates the pins 46 of both arrestor 20, 120 to simultaneously arrest and minimize swinging of load 50. This allows for a lower cost arrestor 120 to be used together with arrestor 20. Such arrangement for minimizing a swinging of load 50 further protects a worker who may be located beneath or adjacent load 50, or who has body parts that may be so situated. Such configuration would be typical of use with a single hook hoist.

Figure 9:
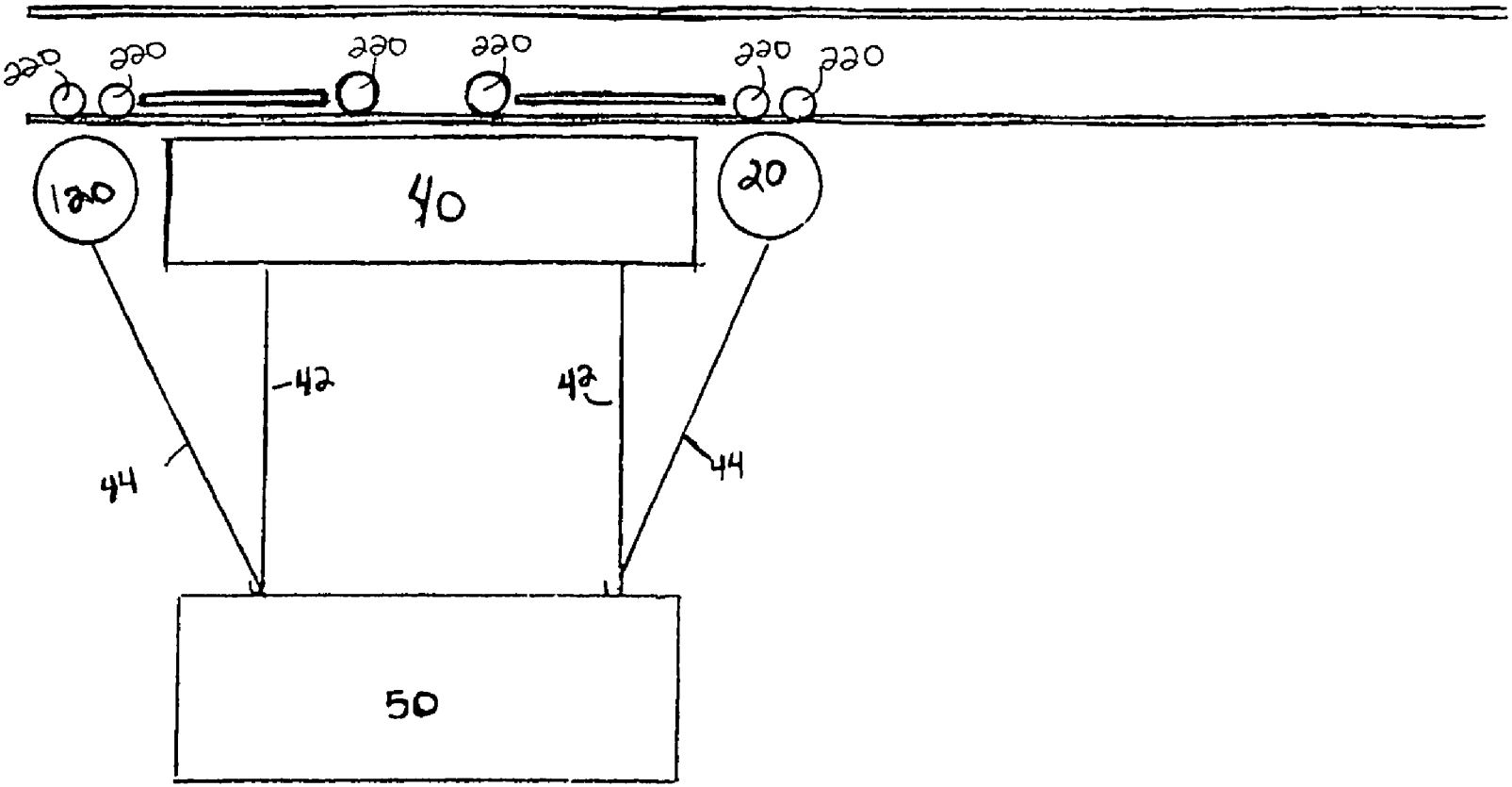
FIG. 9 is an elevation view of a system aspect of the present invention.

FIG. 9 shows a further aspect of the invention, including a safety lifting system 240. Lifting system 240 is similar to the system 200 described above, yet includes a twin hook hoist arrangement as opposed to the single hook arrangement generally shown in FIG. 8. System 240 includes arrestors 20, 120, together with the other features as described above and incorporated herein by reference.

A further aspect of the invention includes a method for arresting a load descending at a rate exceeding a predetermined limit. The method includes the steps of providing at least one arrestor 20, 120 of the variety described herein, connecting the arrestor 20, 120 to a load 50 to be lifted, and programming the controller 62 to send a signal upon sensing of a predetermined deceleration limit to thereby lock the spool 22 and stop the load 50 from descending.

It will be apparent to those skilled in the art that modifications and variations can be made in the device of this invention. The invention in its broader aspects is, therefore, not limited to the specific details or the illustrative examples described above. Thus, it is intended that all matter contained in the foregoing description, drawings and examples shall be interpreted as illustrative and not in a limiting sense.

What is claimed is:

1. A load arrestor for use in conjunction with a primary lift, said load arrestor comprising:

a spool about which winds a safety line for safety support of a load being supported at least in part by the primary lift;

a lock mechanism comprising at least one cylinder having a locking pin for extension into at least one of a plurality of slots to inhibit rotation of said spool;

a sensor for sensing motion of said spool in response to motion of the load;

a controller which activates said at least one cylinder to extend said locking pin when the motion of said spool exceeds a predetermined limit; and a tension mechanism engaged with said spool, wherein said tension mechanism maintains a safety line tension with the load.

2. The load arrestor of claim 1 wherein said lock mechanism includes a side plate rotatable with said spool and defining said plurality of slots.

3. The load arrestor of claim 1 wherein said lock mechanism includes at least two off-set cylinders.

4. The load arrestor of claim 1 wherein at least one of said plurality of slots is an aperture positioned substantially parallel in the axial direction of said spool.

5. The load arrestor of claim 1 wherein said sensor includes an encoder.

6. The load arrestor of claim 1 wherein said arrestor further includes a pressurized air canister in communication with said at least one of said cylinders.

7. The load arrestor of claim 1 wherein said arrestor further includes at least one spring-biased-out and air pressure-retracted cylinder.

8. The load arrestor of claim 7 wherein said at least one spring-biased-out and air pressure-retracted cylinder is configured to activate upon the cylinder pressure dropping below a predetermined pressure limit.

9. The load arrestor of claim 1 wherein said arrestor further includes a solenoid valve and a pressurized air source, said solenoid valve configured to open upon receiving a signal from said controller to allow air from said air source to communicate with said at least one cylinder to activate said locking pin.

10. The load arrestor of claim 9 wherein said solenoid valve is a normally opened valve.

11. The load arrestor of claim 1 wherein said arrestor further includes a rechargeable electric power supply for powering said controller.

12. A load arrestor for use in conjunction with a primary lift, said load arrestor comprising:

a spool about which winds a safety line for safety support of a load being supported at least in part by the primary lift;

a lock mechanism comprising at least two cylinders each having a locking pin for insertion into at least one of a plurality of slots to inhibit rotation of said spool;

a sensor for sensing motion of said spool in response to motion of the load; and a controller which activates at least one of said at least two cylinders to extend said locking pin when the motion of said spool exceeds a predetermined limit.

13. The load arrestor of claim 12 wherein said at least two cylinders are offset.

14. The load arrestor of claim 12 wherein said lock mechanism includes a side plate rotatable with said spool, said plate defining said plurality of slots.

15. The load arrestor of claim 12 further comprising a tension mechanism engaged with said spool.

16. The load arrestor of claim 12 wherein at least one of said plurality of slots is an aperture positioned substantially parallel in the axial direction of said spool.

17. A load arrestor for use in conjunction with a primary lift, said load arrestor comprising:

a spool about which winds a safety line for safety support of a load being supported at least in part by the primary lift;

a lock mechanism comprising at least one cylinder having a locking pin for extension into at least one of a plurality of slots to inhibit rotation of said spool; at least one of said slots being an aperture and positioned substantially parallel in the axial direction of said spool;

a sensor for sensing motion of said spool in response to motion of the load; and a controller which activates said at least one cylinder to extend said locking pin when the motion of said spool exceeds a predetermined limit.

18. The load arrestor of claim 17 wherein said lock mechanism includes a brake plate rotatable with said spool, said brake plate defining said plurality of slots.

19. A load arrestor for use in conjunction with a primary lift, said load arrestor comprising:

a spool about which winds a safety line for safety support of a load being supported at least in part by the primary lift;

a lock mechanism comprising:

a lock plate rotatable with said spool, said plate defining a plurality of slots; and at least one cylinder having a locking pin for extension into at least one of said plurality of slots to inhibit rotation of said lock plate and said spool;

a sensor for sensing motion of said spool in response to motion of the load;

a controller which activates said at least one cylinder to extend said locking pin when the motion of said spool exceeds a predetermined limit; and a tension mechanism engaged with said spool, wherein said tension mechanism maintains a safety line tension with the load.

20. The load arrestor of claim 19 wherein said tension mechanism is one selected from the group comprising a spring, a motor, a synchronizing air motor, or a synchronizing electric motor with sensor.

21. A safety lifting system comprising:

at least one primary lift at least in part capable of supporting a load; and at least one load arrestor for use in conjunction with said primary lift, said load arrestor comprising:

a spool about which winds a safety line for safety support of a load being supported at least in part by said at least one primary lift;

a lock mechanism comprising at least one cylinder having a locking pin for extension into at least one of a plurality of slots to inhibit rotation of said spool;

a sensor for sensing motion of said spool;

a controller which activates said at least one cylinder to extend said locking pin when the motion of said spool exceeds a predetermined limit; and a tension mechanism engaged with said spool, wherein said tension mechanism maintains a safety line tension with the load.

22. The system of claim 21 wherein said at least one primary lift includes one selected from the group comprising a drum, a hoist, a crane, a bridge crane, a pulley, a spool, or mono-rail system, and wherein said lock mechanism includes a side plate rotatable with said spool and defining said plurality of slots.

23. The system of claim 21 wherein said load arrestor further includes a solenoid valve and a pressurized air source, said solenoid valve configured to open upon receiving a signal from said controller to allow air from said air source to communicate with said at least one cylinder to activate said locking pin.

* * * * *